US012780394B1

(12) United States Patent
Bruno et al.

(10) Patent No.: US 12,780,394 B1
(45) Date of Patent: Nov. 3, 2026

(54) PROPULSION SYSTEMS AND METHODS FOR CONTROLLING PROPULSION SYSTEMS FOR MARINE VESSELS TO REDUCE SHIFT CLUNK

(71) Applicant: Brunswick Corporation, Mettawa, IL (US)

(72) Inventors: Corey L. Bruno, Fond du Lac, WI (US); David J. Belter, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 337 days.

(21) Appl. No.: 18/609,910

(22) Filed: Mar. 19, 2024

(51) Int. Cl.
*B63H 25/42* (2006.01)
*B63H 21/21* (2006.01)

(52) U.S. Cl.
CPC ..... *B63H 25/42* (2013.01); *B63H 21/21* (2013.01); *B63H 2021/216* (2013.01)

(58) Field of Classification Search
CPC ..... B63H 25/42; B63H 2021/216
USPC ..... 440/6, 1, 84
See application file for complete search history.

(56) References Cited

U.S. PATENT DOCUMENTS 7,150,664 B1 12/2006 Uppgard
7,255,616 B1 8/2007 Caldwell
7,330,782 B2 * 2/2008 Graham ..... B63H 21/22 701/21
7,467,595 B1 12/2008 Lanyi
9,043,058 B1 5/2015 Camp
9,555,869 B1 * 1/2017 Arbuckle ..... F02D 41/1401
9,957,028 B1 * 5/2018 O'Brien ..... B63H 21/21
10,018,136 B1 7/2018 Anschuetz
10,048,690 B1 8/2018 Hilbert
10,155,577 B1 12/2018 Van Buren
11,358,698 B1 6/2022 Snyder
2010/0280684 A1 * 11/2010 Garon ..... F02D 41/2464 701/21
2019/0041857 A1 * 2/2019 Tamura ..... G05D 1/0208
2022/0252153 A1 8/2022 Snyder
2022/0380014 A1 * 12/2022 Neathery ..... B63H 21/213
2023/0219675 A1 7/2023 Janeczko
2023/0219676 A1 7/2023 Kalnins

* cited by examiner

*Primary Examiner* — Lars A Olson
*Assistant Examiner* — Eric Anthony Starck
(74) *Attorney, Agent, or Firm* — Andrus Intellectual Property Law, LLP

(57) ABSTRACT

A method for controlling a marine vessel to reduce shift clunk. The method includes receiving from an input device a demand for propelling the marine vessel in water and operating a first marine drive to provide propulsion based on the demand from the input device. The method further includes determining whether a preset criteria has been satisfied, the preset criteria being satisfied based on a speed of the marine vessel and/or an elapsed time since the first marine drive started providing propulsion. The method further includes delaying operation of a second marine drive to provide propulsion based on the demand from the input device until the preset criteria has been satisfied to thereby reduce the shift clunk from starting operation of the second marine drive.

21 Claims, 7 Drawing Sheets

PROPULSION SYSTEMS AND METHODS FOR CONTROLLING PROPULSION SYSTEMS FOR MARINE VESSELS TO REDUCE SHIFT CLUNK

FIELD

The present disclosure generally relates to propulsions systems and methods for controlling propulsion systems for marine vessels.

BACKGROUND

The following provide background information and are incorporated by reference in entirety.

U.S. Pat. No. 10,048,690 discloses a method of controlling two or more propulsion devices on a marine vessel that includes receiving a vessel speed, determining that the vessel speed is below a first vessel speed threshold, receiving an operator thrust demand, and determining that the operator thrust demand is below a first demand threshold. At least one of the two or more propulsion devices is then turned off, and a thrust output of at least one remaining propulsion device is adjusted based on the operator thrust demand.

U.S. Pat. No. 10,018,136 discloses a method for controlling a marine engine for propelling a marine vessel that includes receiving user input as a user input device to control acceleration of a marine vessel, detecting a rapid acceleration command based on the user input, and determining an advanced spark timing based on at least one of engine speed and engine load, wherein the advanced spark timing adjusts a base spark time by a spark advance offset. A fuel increase is then determined based on the spark advance offset, and then an increased fuel injection amount is determined by increasing a base fuel injection amount by the fuel increase. Spark and fuel delivery are then controlled for one or more cylinders of the marine engine based on the advanced spark timing and the increased fuel injection amount.

U.S. Patent Application Publication Nos. US 2023/0219675 and 2023/0219676 disclose methods for controlling electric propulsion systems to propel a marine vessel.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One aspect of the present disclosure generally relates to a method for controlling a marine vessel. The method includes receiving from an input device a demand for propelling the marine vessel in water and operating a first marine drive to provide propulsion based on the demand from the input device. The method further include determining whether a preset criteria has been satisfied, the preset criteria being satisfied based on a speed of the marine vessel and/or an elapsed time since the first marine drive started providing propulsion. The method further includes delaying operation of a second marine drive to provide propulsion based on the demand from the input device until the preset criteria has been satisfied.

In certain examples, operating the first marine drive includes operating an electric motor thereof to provide the propulsion.

Another aspect according to the present disclosure generally relates to a method for controlling a marine vessel. The method includes receiving from an input device a demand for propelling the marine vessel in water and operating a first marine drive to provide propulsion based on the demand. The method further includes determining whether the demand exceeds a demand threshold and operating a second marine drive to provide propulsion based on the demand when the demand exceeds the demand threshold. The method further includes determining, when the demand does not exceed the demand threshold, whether a preset criteria has been satisfied, the preset criteria being satisfied based on a speed of the marine vessel and/or an elapsed time since the first marine drive started providing propulsion, and delaying operation of a second marine drive to provide propulsion based on the demand until the preset criteria has been satisfied. Delaying operation of the second marine drive until the preset criteria has been satisfied.

In certain examples, operating the first marine drive comprises operating an electric motor thereof to provide the propulsion. In further examples, operating the second marine drive comprises operating an engine thereof to provide the propulsion.

In certain examples, the demand threshold is at least 80% of wide open throttle.

In certain examples, determining whether the preset criteria is satisfied comprises measuring the speed of the marine vessel via a speed sensor and comparing the speed to a speed threshold. In further examples, the speed threshold is between 2 and 10 mph.

In certain examples, determining whether the preset criteria is satisfied comprises inferring the speed of the marine vessel via a sensor associated with the first marine drive. In further examples, the sensor of the first marine drive measures a rotational speed corresponding to the first marine drive.

In certain examples, determining whether the preset criteria is satisfied comprises counting the elapsed time since the first marine drive started to provide the propulsion and the preset criteria is satisfied when the elapsed time exceeds a time threshold. In further examples, the time threshold is between 0.5 and 5 seconds.

In certain examples, the preset criteria can be satisfied by either the speed of the marine vessel exceeding a speed threshold or the elapsed time since the first marine drive started providing propulsion exceeding a time threshold after which the second marine drive is operated regardless of the speed of the marine vessel. In further examples, the time threshold is between 2 and 15 seconds.

In certain examples, determining whether the preset criteria has been satisfied comprises determining a rate of change of a speed of the marine vessel while the first marine drive is operating and comparing the rate of change to a change rate threshold such that the preset criteria is satisfied when the rate of change is below the change rate threshold.

Another aspect of the present disclosure generally relates to a propulsion system for a marine vessel. The propulsion system includes a first marine drive and a second marine drive each configured to provide propulsion for the marine vessel in water. An input device is configured to provide a demand for propelling the marine vessel. A controller is operatively coupled to the first marine drive, the second marine drive, and the input device, and is configured to control the first marine drive to provide the propulsion based on the demand received from the input device, to determine whether a preset criteria has been satisfied, the preset criteria being satisfied based on a speed of the marine vessel and/or an elapsed time since the first marine drive started providing propulsion, and to delay the second marine drive providing the propulsion based on the demand received from the input device until the preset criteria has been satisfied.

In certain examples, the preset criteria can be satisfied by either the speed of the marine vessel exceeding a speed threshold or the elapsed time since the first marine drive started providing propulsion exceeding a time threshold after which the second marine drive is operated regardless of the speed of the marine vessel. In further examples, the time threshold is between 2 and 15 seconds.

In certain examples, the first marine drive comprises an electric motor for providing the propulsion.

In certain examples, the second marine drive is at least two second marine drives, and wherein after the preset criteria is satisfied the at least two second marine drives are controlled to provide the propulsion corresponding thereto together.

Another aspect according to the present disclosure generally relates to a method for controlling a marine vessel. The method includes receiving from an input device a demand for propelling the marine vessel in water and determining whether a slow idle mode has been selected for propelling the marine vessel. The method further includes operating a first marine drive to provide propulsion based on the demand from the input device and operating a second marine drive to provide propulsion based on the demand from the input device when the slow idle mode is determined to be unselected. The method further includes determining, when the slow idle mode is determined to be selected, whether the demand exceeds a demand threshold, and delaying operation of the second marine drive to provide propulsion based on the demand from the input device until the demand exceeds the demand threshold.

It should be recognized that the different aspects described throughout this disclosure may be combined in different manners, including those than expressly disclosed in the provided examples, while still constituting an invention accord to the present disclosure.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Through experimentation and development, the present inventor have identified remaining challenges with propulsion systems known in the art for marine vessels, as well as new solutions for addressing these challenges. In particular, marine drives suffer from "shift clunk" when they first shift into gear to propel a marine vessel. While advances have been made to reduce this shift clunk from a hardware perspective, such as providing further shock absorption for gearcases and components within the drivetrain, these increase the cost, complexity, and size of the marine drive. Furthermore, while these hardware solutions may reduce the noise and/or feel of shift clunk to some extent, further improvement to these negative effects is desired.

Figure 1:
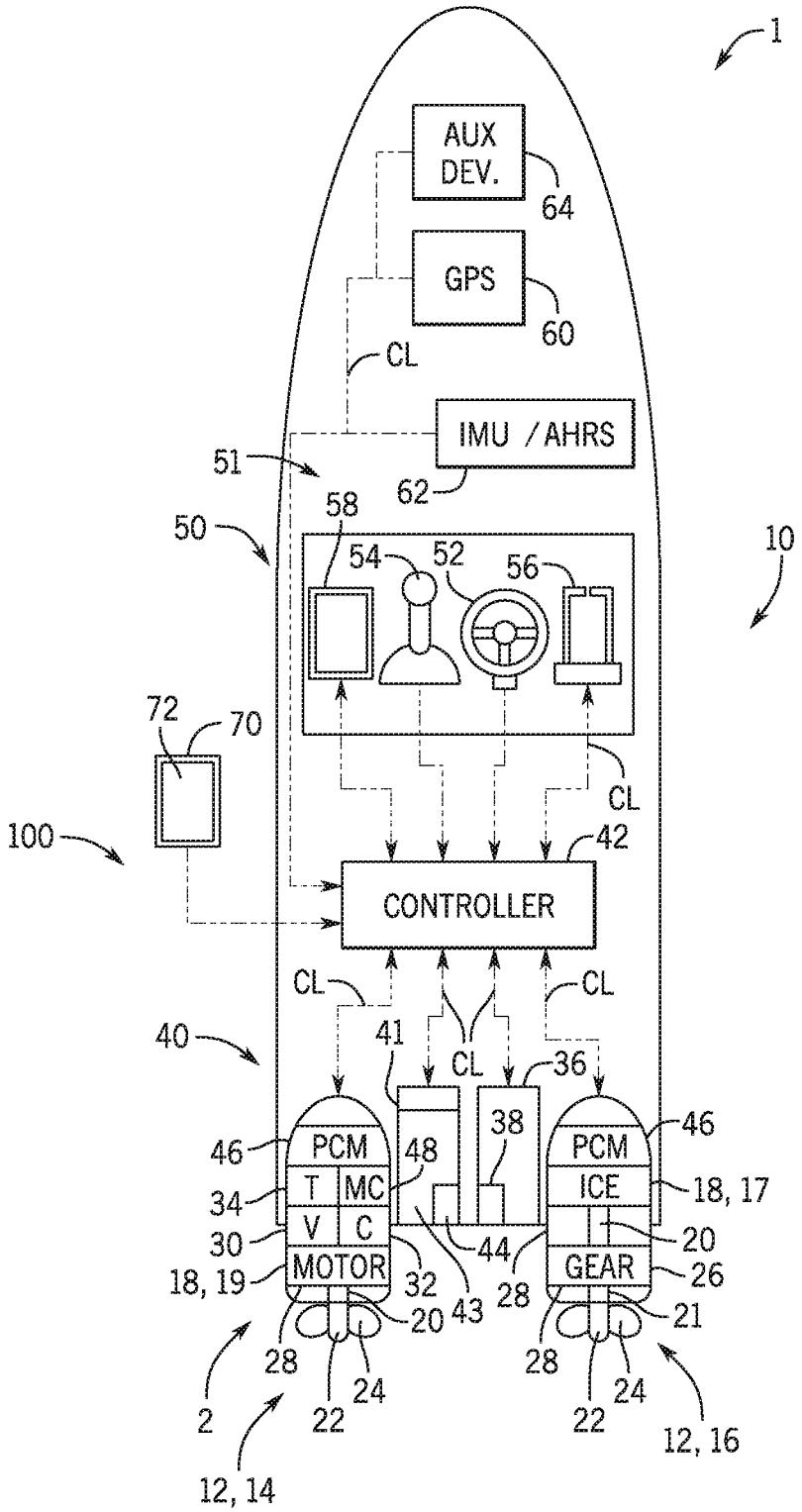
FIG. 1 is a top view of a marine vessel incorporating one embodiment of a propulsion system according to the present disclosure.

FIG. 1 depicts an example of a propulsion system 10 for a marine vessel 1 according to the present disclosure, which is configured to propel the marine vessel in a direction instructed by an operator via a steering control system, or by a guidance system configured to automatically control steering of the marine vessel to steer the vessel toward a predetermined location or global position. The marine vessel 1 may be steered in a conventional manner, such as by controlling a marine drive or a rudder via a steering actuator. Additional information regarding exemplary steering actuators is provided in U.S. Pat. Nos. 7,150,664; 7,255,616; and 7,467,595, which are incorporated by reference herein.

The propulsion system 10 includes at least two marine drives 12 each configured to propel the marine vessel 1 through the water. For demonstration purposes, the present marine vessel 1 is shown to have two different marine devices 12, specifically an electric marine drive 14 and a gasoline powered marine drive 16 each steerable by conventional steering actuators). While the marine drives 12 are shown as outboard motors, these could instead be inboard motors, stern drives, pod drives, and/or jet drives. Each marine drive 12 includes a powerhead 18. The powerheads 18 may be internal combustion engines (ICE) 17 (e.g., gasoline or diesel engines, gasoline for the gasoline powered marine drive 16), electric motors 19 (e.g., for the electric marine drive 14), and/or hybrids thereof. Examples of powerheads 18 for electric marine drives include, for example, a brushless DC motor, a DC brushed motor, an AC brushless motor, a direct drive, a permanent magnet synchronous motor, an induction motor, or any other device that converts electric power to rotational motion. In certain embodiments, the powerheads 18 include a rotor and a stator in a known configuration.

Each powerhead 18 has a drive shaft 20 that rotates during operation. Each drive shaft 20 is connected in a torque-transmitting relationship with a propeller shaft 22 that rotates a propeller 24 connected thereto. In this manner, each powerhead 18 rotates a corresponding propeller 24 to generate thrust in the water. As will be known to one of ordinary skill in the art, the propeller 24 may include one or more propellers, impellers, or other propulsor devices and that the term "propeller" may be used to refer to all such devices.

In certain configurations, the drive shaft 20 of the powerhead 18 is connected to the propeller shaft 22 via a gear system 26 or transmission. In this case the gear system 26 or transmission receives rotation from the drive shaft 20 as an input and selectively rotates an output shaft 21 as an output. In particular, the gear system 26 is operable to adjust conversion of the rotation and/or to disconnect the propeller shaft 22 from the drive shaft 20 therethrough, as is sometimes referred to in the art as a "neutral" position in which rotation of the drive shaft 20 is not translated to the propeller shaft 22. The gear system 26 may also shift between "forward" and "reverse" positions, which changes the direction in which the propeller shaft 22 is caused to rotate by rotation of the drive shaft 20. Various gear systems 26, or transmissions, are well-known in the relevant art. In other examples, the powerhead may directly connect to the propeller shaft 22 such that rotation of the drive shaft 20 is directly transmitted to the propeller shaft 22 at a constant and fixed ratio (e.g., for an electric marine drive 14). Shifting a marine drive 12 from neutral to either forward or reverse, or to begin generating propulsion generally, may also be referred to as "engaging" the marine drive 12. Likewise, disengaging the marine drive 12 corresponds to causing the marine drive 12 to no longer generate propulsion, such as by stopping rotation of the powerhead 18 and/or transitioning into a neutral position. In general, the present inventors have identified that it is this shifting out of neutral that creates "shift clunk," which is essentially caused by the abrupt change in speed of suddenly engaging a stationary propeller shaft with a rotating powerhead to rotate together.

With continued reference to FIG. 1, the marine drives 12 further include powerhead sensors measuring various aspects of the powerheads 18, including a speed in which the powerhead 18 is operating. In certain examples, the powerhead sensors are speed sensors 28 that measure a rotational speed of the drive shaft 20, the output shaft 21, and/or the propeller shaft 22. The shaft rotation sensor 28 may be a Hall-Effect sensor or another rotation sensor that measures the rotational speed in rotations per minute (RPM) in a manner known in the art (e.g., using capacitive or inductive measuring techniques).

Other examples of powerhead sensors, particularly in the case of an electric marine drive 14, include a voltage sensor 30, a current sensor 32, and/or a torque sensor 34 configured to sense an input voltage to the electric motor 19, an input current to the electric motor 19, and a torque output of the electric motor 19, respectively. Accordingly, power delivered to the electric motor 19 can be calculated based on the measurements of the voltage sensor 30 and the current sensor 32. In certain examples, one or more of the parameters, such as the speed, torque, or power to the electric motor 19, may be calculated based on other measured parameters or characteristics of the various sensors. For example, the torque may be calculated based on power characteristics in relation to the rotation speed of the electric motor. As will be discussed further below, these measurements and calculations can then be used for monitoring and controlling the propulsion system 10, including for monitoring and controlling the powerheads 18.

The marine drives 12 are connected so as to receive energy from one or more energy sources. In the case of a gasoline powered marine drive 16, the energy is gasoline and the energy source is a fuel tank 36 fluidly connected to the ICE 17 in a conventional manner. A fuel level sensor 38 is configured to measure the amount of fuel remaining in the fuel tank 36 in a conventional manner (e.g., a Hall effect sensor that measures a position of a float within the fuel tank 36).

In the case of an electric marine drive 14, the energy is electrical power, and the energy source is a power storage system 40. The power storage system 40 stores electrical energy for powering the electric motor 19 and is rechargeable, such as by connection to shore power. Various power storage devices and systems are known in the relevant art. The power storage system 40 may be a battery system including one or more batteries or banks of batteries. For example, the power storage system 40 may include one or more lithium-ion (LI) battery systems, each LI battery comprised of multiple battery cells. In other embodiments, the power storage system 40 may include one or more lead-acid batteries, fuel cells, flow batteries, ultracapacitors, and/or other devices capable of storing and outputting electric energy.

The amount of energy available within the energy source for operating the marine drives 12 may also be referred to as the "remaining energy". By way of example, this may be measured in kilowatt-hours, amp-hours, or other electrical measures in the case of electrical energy stored in energy sources, and/or as a volume such as liters or gallons in the case of energy stored in fuel tanks 36. Techniques for determining the remaining energy of electrical and fuel-based energy sources are well-known in the art and thus not described further here.

With continued reference to FIG. 1, a control system 100 controls the propulsion system 10, wherein the control system 100 may include a plurality of control devices configured to cooperate to provide the method of controlling the propulsion system described herein. For example, the control system 100 includes a central controller 42, a battery controller (BC) 44, a propulsion control module (PCM) 46, and one or more motor controllers 48, trim controllers, steering controllers, etc. The different controllers 44, 46, 48, and 42 may be communicatively connected via communication links CL, which may be as a communication bus such as a CAN bus or a LIN bus, or by single dedicated communication links between components. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected. In certain embodiments, the controller 42, battery controller 44, and PCM 46 are contained entirely within the marine drive itself (e.g., an electric marine drive).

Each controller may comprise a processor and a storage device, or memory, configured to store software and/or data utilized for controlling and or tracking operation of the electric propulsion system 2. The memory may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. An input/output (I/O) system provides communication between the control system 100 and peripheral devices.

In certain embodiments, various sensing devices 28, 30, 32, 34, and/or 38 may be configured to communicate with a local controller, such as the motor controller 48, a propulsion control module PCM 46, or battery controller 44. In other embodiments, the various sensing devices 28, 30, 32, 34, and/or 38 may communicate with the central controller 42, which may permit eliminating one or more local controllers. In the example of FIG. 1, the voltage sensor 30 and the current sensor 32 may be communicatively connected to the motor controller 48 to provide measurement of the voltage supplied to the motor and current supplied to the electric motor 19. The motor controller 48 is configured to provide appropriate current and or voltage to meet the demand request for controlling the electric motor 19. For example, a demand input may be received at the motor controller 48 from the central controller 42 (shown here via a propulsion control module 46) such as based on an operator demand at a helm input device. The motor controller 48, voltage sensor 30, and current sensor 32 may be integrated into a housing of the electric motor 19. In other embodiments, the motor controller 48 may be separately housed, as well as the propulsion control module 46.

Each electric motor 19 may be associated with its own motor controller 48 configured to control power to the electric motor, such as to the stator winding thereof. The motor controller 48 is configured to control the function and output of the electric motor 19, such as controlling the torque outputted by the motor, the rotational speed of the electric motor 19, as well as the input current, voltage, and power supplied to and utilized by the electric motor 19. In one arrangement, the motor controller 48 controls the current delivered to the stator windings via leads connected to the electric motor 19, which input electrical energy to the electric motor to induce and control rotation of the rotor.

The power storage system 40 may further include a battery controller 44 configured to monitor and/or control aspects of the power storage system 40. The battery controller 44 may further be configured to receive information from current, voltage, and/or other sensors within the power storage system 40, such as to receive information about the voltage, current, and temperature of each battery cell or group of battery cells within the power storage system 40. For example, the battery controller 44 may receive inputs from one or more sensors within the power storage system 40, such as one or more voltage, current, and temperature sensors within a housing for the power storage system 40. As described above, voltage sensors 30 may be configured to sense voltage within the battery (such as cell voltage sensors configured to sense the voltage of individual cells or groups of cells in a LI battery) and one or more temperature sensors may be configured to sense a temperature within a housing of the power storage system 40 where one or more batteries or other storage elements are located. The battery controller 44 or other controller in the system is configured to calculate a charge level, such as a state of charge, of the power storage system 40. A battery charging system 41 is also provided for charging the battery 43, which may be configured as well-known in the art and is thus not described further herein.

With continued reference to FIG. 1, additional components are also provided in communication with the control system 100, each of which may function as an input thereto and/or output thereof. In the example shown, the controller 42 also receives input from and/or communicates with one or more user interface devices within a user interface system 50 via the communication links CL, which in some embodiments may be the same communication link as utilized for communication between the controllers 44, 46, and 48, or may be a separate communication link. The user interface devices 50 in the exemplary embodiment include a steering wheel 52, a joystick 54, throttle levers 56, and a display device 58 positioned at a helm 51.

The steering wheel 52 and joystick 54 may be configured to receive user inputs in conventional manners, which subsequently may communicate with the controller 42 to effectuate steering control over the marine vessel 1, such as by steering marine drives 12, which is well-known and typically referred to as steer-by-wire arrangements. Other steer arrangements, such as steering cable systems arrangements, are well-known in the art and could alternatively be implemented.

Likewise, the throttle levers 56 may be configured to receive user inputs in a conventional manner (also referred to as receiving a requested speed or a demand request), including both a magnitude and a direction for generating thrust, which may be subsequently communicated with the controller 42. In particular, the throttle levers 56 may communicate with the controller 42 to effectuate control of the output of the powerheads 18 of the marine drives 12, which is well-known and typically referred to as a throttle-by-wire arrangement. By way of example, rotating one of the throttle levers 56 in a forward direction away from its neutral, detent position could be interpreted as a value from 0% to 100% demand request that corresponds, via an input/output map such as a look up table, to control the output of the powerhead 18 for the corresponding marine drive 12. It should be recognized that demand requests for throttle may also be received by a joystick 54.

In the case of a gasoline powered marine drive 16, rotating the throttle lever 56 may effectuate control a throttle valve position (and in certain examples, the transmission being shifted for rotating the propeller in the forward direction). This may occur through communication between the central controller 42 and a propulsion control module 46. In the case of an electric marine drive 14, rotating the throttle lever 56 may effectuate control of how much power is provided to the electric motor 19 rotating in the forward direction. This may occur through communication with a motor controller 48 and/or propulsion control module 46.

The input/output map may provide that no power is provided to the electric motor 19, or that the throttle valves are closed to an idle position of ICE 17, when the throttle lever 56 is in the neutral, detent position (i.e., 0% demand request). Likewise, maximum power may be provided to the electric motor 19, or the throttle valves being fully open of the ICE 17, when the throttle lever 56 is pushed forward to its furthest extent (i.e., 100% demand request). It should be recognized that the throttle lever 56 being pushed backwards to its furthest extent (e.g., −100% demand request) responds oppositely, generating a corresponding thrust in an opposite direction, which may involve shifting the transmission in a conventional manner.

The present disclosure also contemplates alternate configurations, such as marine drives having tiller handles for controlling steering and throttle (and in either electric, fuel-based, or hybrid configurations). Likewise, demand requests may be received other than from throttle levers or grips, for example from cruise control or auto-pilot operational modes known in the art.

The display device 58 is configured to display information for the user, as well as to receive input commands relating to steering, thrust, and/or other functions of the marine vessel and/or marine drive. This includes the programming of destinations and waypoints for autopiloting. In particular, the display device 58 may be a multi-functional display device permitting touch-screen inputs from the user. It should be recognized that other input devices may also be provided, such as keyboards, trackpads, roller balls, and the like. In various embodiments, the display device 58 may be, for example, part of an onboard management system, such as the VesselView™ by Mercury Marine of Fond du Lac, Wisconsin.

The onboard management system may also or alternatively be controlled through an external device 70 that wirelessly communicates with the controller 42, such as a tablet or smartphone communicating via wireless protocols known in the art (e.g., Wi-Fi or Bluetooth®). The external device 70 may have a processor, storage device, and an input/output (I/O) system in the same manner as other controllers discussed above. The processor may be configured to execute an application stored in the storage device that enables the user to receive information from the controller 42 relating to the marine drives 12 and the marine vessel 1 more generally, to input a destination for propelling the marine vessel, and to provide input commands to the controller 42 for controlling the marine drives 12 and the marine vessel 1 more generally. By way of example, the external device 70 may be configured to operate an application such as the "Mercury Marine" App or the VesselView™ Mobile App each provided by Mercury Marine of Fond du Lac, Wisconsin. In each case, the applications allow the user to receive information and to provide input commands via a user interface 72 of the external device 70, such as via a touchscreen. In this manner, the external device 70 may also constitute a controller within the control system 100.

Other components may also communicate with the controller 42, such as a GPS system 60 configured to determine a current global position of the vessel, track vessel position over time, and/or determine vessel speed and direction of travel and to provide this information to the controller 42. Alternatively, or additionally, vessel speed may be measured by a speed-over-water sensor such as a pitot tube or a paddle wheel and such information may be provided to the controller 42. This communication may again be provided via CAN bus, LIN bus, or single dedicated communication links (e.g., each shown as CL in FIGS. 1-2).

The marine vessel 1 may also include an inertial measurement unit (IMU) or an attitude and heading reference system (AHRS) (collectively shown as the IMU/AHRS 62). An IMU has a solid state, rate gyro electronic compass that indicates the vessel heading and solid-state accelerometers and angular rate sensors that sense the vessel's attitude and rate of turn. An AHRS provides 3D orientation of the marine vessel 1 by integrating gyroscopic measurements, accelerometer data, and magnetometer data. The IMU/AHRS 62 could be GPS-enabled, in which case a separate GPS system 60 would not be required. The IMU/AHRS 62 may communicate with the controller 42 in a similar manner to the GPS system 60.

In addition to the electric marine drive 14, the GPS 60, the IMU/AHRS 62, and other electrical devices are also powered by the power storage system 40. In particular, the power storage system 40 may further be configured to power auxiliary devices 64 on the marine vessel 1 that may not be part of the propulsion system 10. Such as a bilge pump, a cabin light, a stereo system, a water heater, a refrigerator, an air conditioner or other climate/comfort control devices on the vessel, communication systems, navigation systems, and/or the like.

Figure 2:
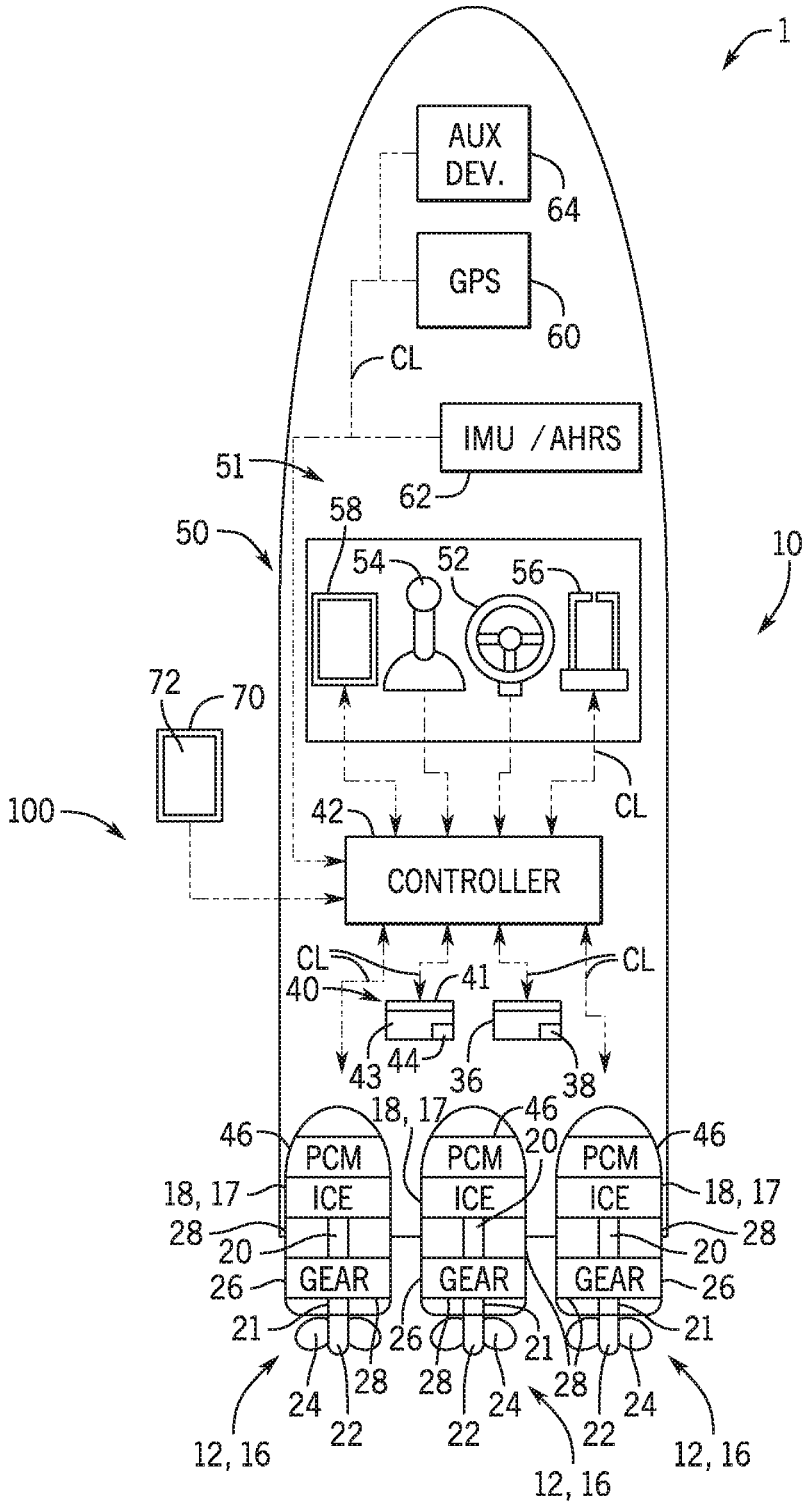
FIG. 2 is a top view of a marine vessel incorporating another embodiment of a propulsion system according to the present disclosure.

FIG. 2 shows another marine vessel 1 configured according to the present disclosure, in this example being propelled in the water by a propulsion system 10 that includes three gasoline powered marine drives 16. It should be recognized that this is merely one additional example and the present disclosure contemplates configurations of propulsion systems having differing numbers and configurations of marine drives.

Figure 3:
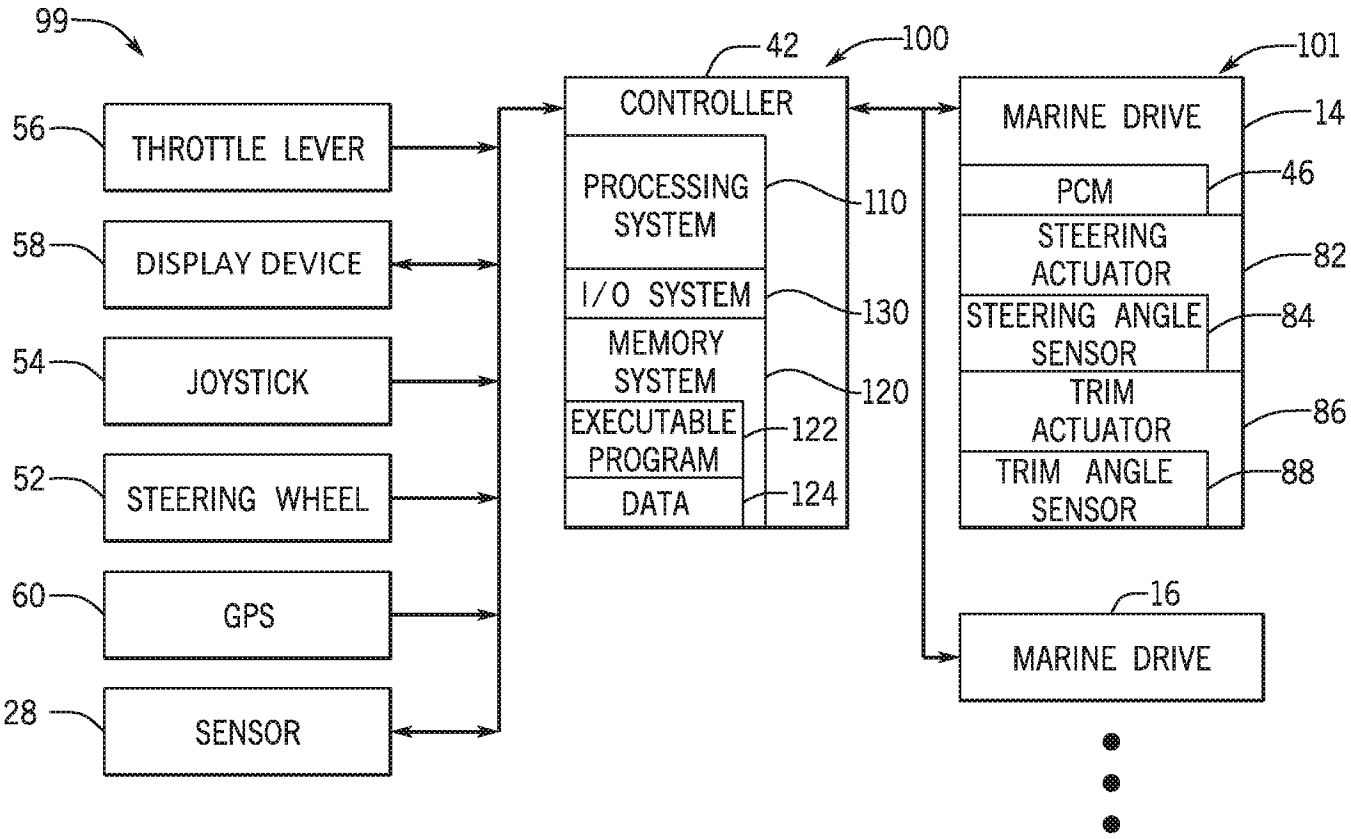
FIG. 3 is a schematic view of a control system such as may be incorporated within a propulsion system according to the present disclosure.

With reference to FIG. 3, additional information is now provided for an example of the control system 100 such as may be incorporated within the marine vessel 1 of FIG. 1. Certain examples of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 100 communicates with each of the one or more components of the marine propulsion system 10 via a communication link CL, which can be any wired or wireless link. The control system 100 is capable of receiving information and/or controlling one or more operational characteristics of the propulsion system 10 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the system 10. Moreover, the communication link CL lines are meant only to demonstrate that the various control elements are capable of communicating with one another, and do not represent actual wiring connections between the various elements, nor do they represent the only paths of communication between the elements. Additionally, the propulsion system 10 may incorporate various types of communication devices and systems, and thus the illustrated communication links CL may in fact represent various different types of wireless and/or wired data communication systems.

The control system 100 may be a computing system that includes a processing system 110, memory system 120, and input/output (I/O) system 130 for communicating with other devices, such as input devices 99 and output devices 101. The processing system 110 loads and executes an executable program 122 from the memory system 120, accesses data 124 stored within the memory system 120, and directs the propulsion system 10 and the marine vessel 1 generally to operate as described in further detail below. The processing system 110 may be implemented as a single microprocessor or other circuitry or be distributed across multiple processing devices or sub-systems that cooperate to execute the executable program 122 from the memory system 120. Non-limiting examples of the processing system include general purpose central processing units, application specific processors, and logic devices. The memory system 120 may comprise any storage media readable by the processing system 110 and capable of storing the executable program 122 and/or data 124. The memory system 120 may be implemented as a single storage device or be distributed across multiple storage devices or sub-systems that cooperate to store computer readable instructions, data structures, program modules, or other data.

FIG. 3 also shows other components that may be controlled by the control system 100, such as a steering actuator 82 and associated steering angle sensor 84, and a trim actuator 86 and trim angle sensor 88, each of which may be conventional and is thus not described further herein. The control system 100 may also control the operation of a light or other notification devices (e.g., display screens, speakers, buzzers, vibration devices), which may be in addition to or as an alternative to similar notification functionalities of an external device 70 (FIG. 1) or display device 58.

As discussed above, the present inventors have recognized that systems and methods presently known in the art suffer from undesirable shift clunk when engaging a marine drive in gear (e.g., shifting from neutral to forward gear). Through experimentation and development, the present inventors have further determined that this shift clunk can be dramatically reduced or even eliminated by shifting a marine drive into gear after its propeller shaft is already spinning to some extent. This lessens the dramatic shock of rapidly changing the static inertia of the propeller shaft and the rotational inertia from the powerhead to spin at the same rate within the coupling gearset, as the propeller shaft is no longer stationary. Through further experimentation and development, the present inventors have recognized that for a propulsion system 10 that includes two or more marine drives 12, one or more marine drives can be used to reduce or eliminate the shift clunk of engaging other marine drives. In particular, if one or more marine drives is operated to propel the marine vessel in the water, the other one or more marine drives can be configured to "free wheel" such that the motion of the marine vessel causes the corresponding propeller shafts to rotate as the propeller is pulled through the water.

Once the propeller shafts of these other marine drives are also rotating, these other marine drives can be shifted into gear without experiencing unpleasant shift clunk. In certain configurations, the present inventors have identified that the marine vessel being propelled in the water between 2 and 10 miles per hour causes the propeller shafts of the non-engaged marine drives to free wheel sufficiently so as to virtually eliminate shift clunk. In further examples, the optimal speed was experimentally identified to be between 4 and 7 miles per hour. However, it should be recognized that the present disclosure contemplates other ranges of speeds that are greater than 10 miles per hour and/or less than 2 miles per hour, which may still cause the desired free wheeling of non-engaged marine drives to reduce shift clunk.

Therefore, as an example, rather than experiencing shift clunk for four or more marine drives on a marine vessel, a single marine drive may engage in a typical manner and the remaining three or more drives may follow soon thereafter with greatly improved or eliminated shift clunk, for example. As stated above, this provides a much more pleasant user experience on the water, and also reduces the wear and tear on the marine drives. In certain embodiments, the "leading" marine drive may even be alternated so as to spread the additional wear out across more evenly.

The present inventors have identified even further ways for improving the overall shift clunk experience for marine vessels having two or more marine drives. In the case of a marine vessel having marine drives of varying capacity (e.g., different horsepower), the shift clunk may vary across these marine drives, for example with a lower horsepower marine drive yielding more mild shift clunk. In this example, propulsion systems controlled according to the present disclosure allow the most mild clunking marine drive to be the leading marine drive that engages first to propel the marine vessel. Once the additional, larger marine drives are free wheeling, these additional marine drives are then engaged without the unpleasant shift clunk they would otherwise provide.

The present inventors have identified even further benefits can be achieved for propulsion systems having a mix of an electric and ICE marine drives. In particular, the electric marine drive, by virtue of using a directly connected electric motor as the powerhead, produces no shift clunk to begin with. The ICE marine drives, on the other hand, do suffer from shift clunk as discussed above. As such, propulsion systems configured according to the present disclosure can be configured to first operate the electric marine drive or drives to provide propulsion for the marine vessel, followed by the ICE marine drives or drives after they are sufficiently free wheeling as described above. This further eliminates the shift clunk for even the leading marine drive, providing a smooth and desirable experience and reduced wear for all marine drives.

Figure 4:
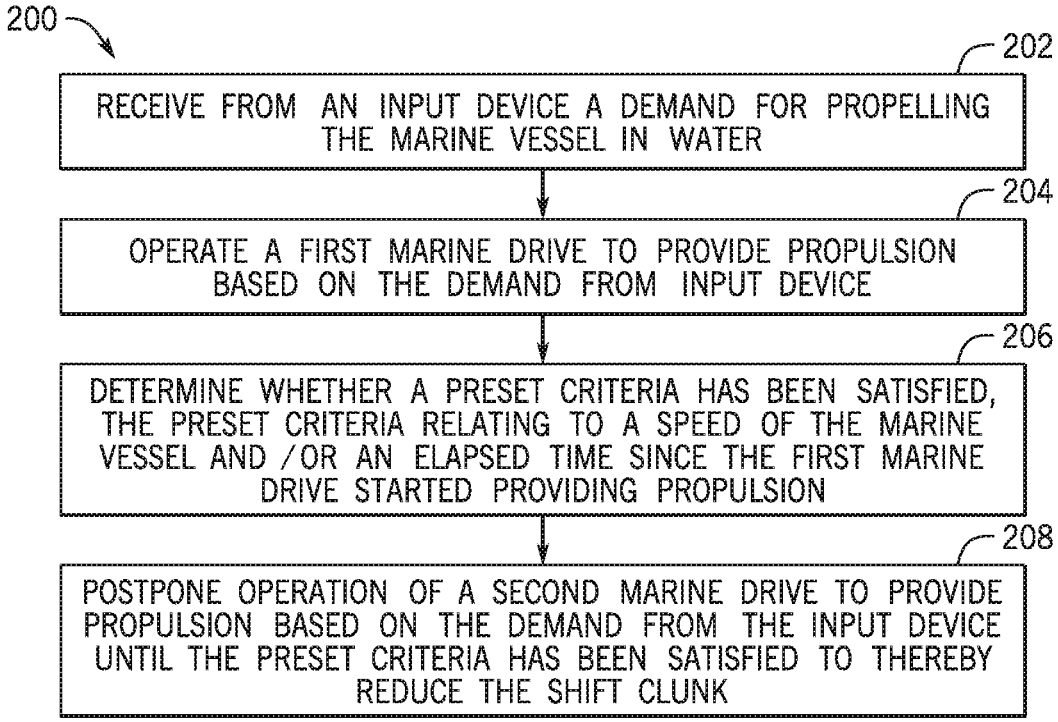
FIG. 4 is a flow chart showing one method for controlling a marine vessel to reduce shift clunk according to the present disclosure.

FIG. 4 depicts a high level flow chart of one example of a method 200 for controlling a marine vessel to reduce shift clunk according to the present disclosure. Step 202 provides for receiving from an input device (e.g., a throttle lever or joystick) a demand for propelling the marine vessel in water. By way of example, this may be receiving a demand corresponding to a throttle lever being moved to the 50% forward demand position. Step 204 provides for operating a first marine drive or drives to provide propulsion based on the demand from the input device. In certain examples in which an electric marine drive is present, it is advantageous for the electric marine drive to be operated as the first marine drive or drives. Likewise, if one or more ICE marine drives has less shift clunk than others (perhaps being lower output, and/or having sophisticated mechanisms to reduce shift clunk), that one or more ICE marine drive may be operated as the first one or more marine drives.

Step 206 then provides for determining whether a preset criteria has been satisfied, whereby there are mechanisms for which the preset criteria may be satisfied, one of which relating to a speed of the marine vessel. The speed of the marine vessel may be determined in a conventional manner using GPS 60 (FIG. 1), water wheels, pitot tubes, or other mechanisms known in the art. The speed may be also inferred, for example by correlating a 500 RPM rotational speed reading for a given marine drive to an estimated 5 mph of vessel speed expected to be provided. This rotational speed may then be stored in memory as a rotational speed, or an equivalent estimated speed through the water, for use in comparisons to actual rotational speeds or measured speeds through the water according to the present disclosure.

In this manner, the preset criteria may be satisfied when the speed measured by the GPS or other mechanism exceeds a speed threshold stored in memory, for example being 4 mph, 5 mph, or others. Another mechanism by which the preset criteria may be satisfied is the elapsed time since the first one or more marine drives started providing propulsion for the marine vessel exceeds a time threshold stored in memory, for example being between 2 and 15 seconds, which is discussed further below.

The process waits until the preset criteria is satisfied or met, meaning that the speed measured for the marine vessel reaches the speed threshold, and/or the elapsed time reaches the time threshold. Step 208 then provides for delaying or postponing operation of a second one or more marine drives to provide propulsion, also based on the demand from the input device from step 202, until the preset criteria has been satisfied. In other words, the second one or more marine drive (and in certain examples any additional, such as a third, fourth, fifth, and sixth marine drive, etc.) are not engaged to operate until the speed of the marine vessel is determined to have reached the preset criteria or threshold from step 206, or a maximum time for trying to reach this speed has elapsed (the time threshold). It should also be recognized that the preset criteria need not include both of these mechanisms in all embodiments. For example, the preset criteria could include comparison of a speed only, without including a bailout time as discussed further below.

In this manner, the shift clunk from starting operation of the second one or more marine drives is reduced by delaying this operation until after the marine vessel is already moving at a speed threshold set as the preset criteria. Further variations on this method and details thereof are provided below.

Through experimentation, the present inventors have recognized that in certain configurations, the speed threshold can be met by operation of the first one or more marine drives surprisingly fast, often within less than 2 seconds, or even less than 1 second, from first operating the first one or more marine drives, at which time the second and any additional marine drives may be engaged for operation without creating shift clunk. In many configurations, the delay is not discernable by the operator. Moreover, the delay is so brief that any effects of yaw or steering vectoring from operating only a single marine drive rather than multiple are minimal or non-existent. In alternative examples in which an effect on yaw or the like could occur, or would be preferably avoided, a center or more central marine drive or two marine drives an equal distance from the center of the vessel may be designated as the first one or more marine drive to avoid this consequence.

Figure 5:
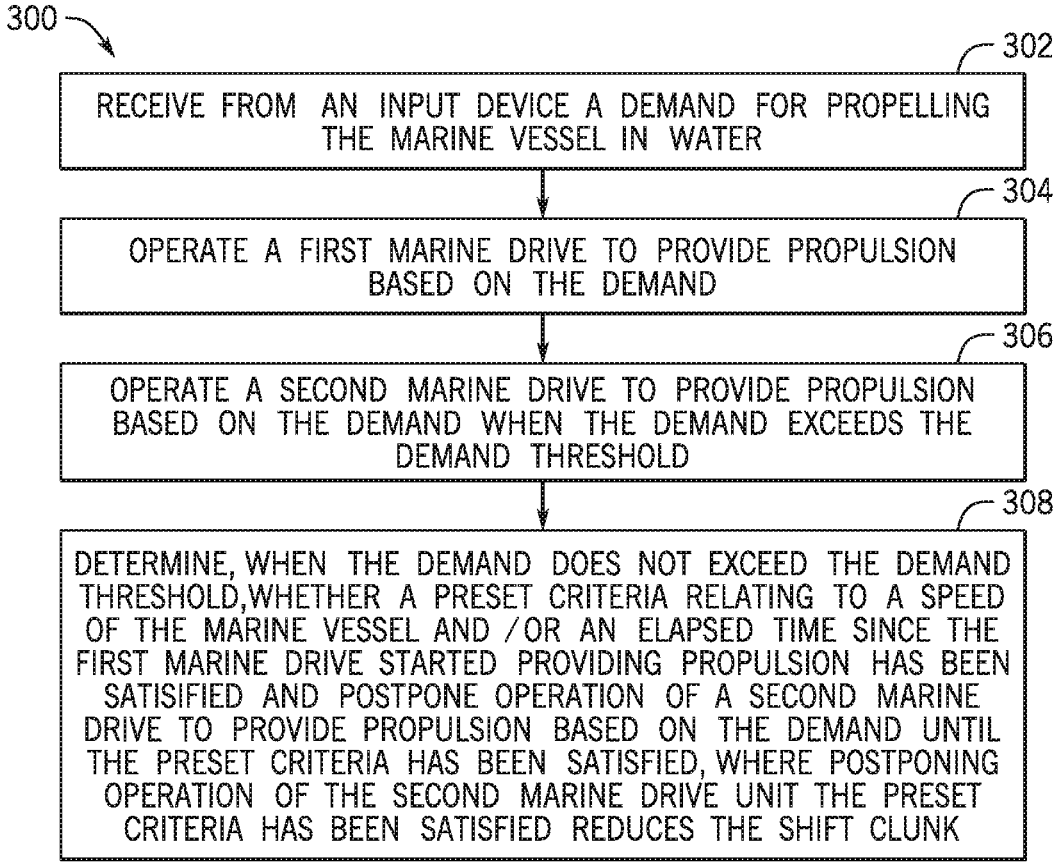
FIG. 5 is a flow chart showing another method for controlling a marine vessel to reduce shift clunk according to the present disclosure.

Notwithstanding these benefits, the present inventors have recognized that in certain use cases, it may be undesirable to delay operation for the second and any additional marine drives by even 1 second, such as when the user requests full throttle, or a "hole shot". As such, further systems and methods according to the present disclosure provide for recognizing whether this unique throttle demand condition is being requested, and delaying operation of marine drives to avoid shift clunk only when the faster response is not needed. FIG. 5 depicts a high level flow chart of another example of a method 300 for controlling a marine vessel to reduce shift clunk according to the present disclosure, but with consideration such that this occurs only when maximum output is not being requested. Steps 302 and 304 may proceed in a same or similar manner as steps 202 and 204 and are thus not repeated here. In step 306, the method provides for operating a second one or more marine drives to provide propulsion based on the demand received in step 302 when this demand exceeds a threshold demand. Additional detail on this is provided below. In short, a demand threshold is saved in memory and compared to the demand received from the input device, whereby the demand threshold corresponds to that of a "hole shot," for example 80%, 85%, 90%, 95% of wide open throttle as the demand and/or a particular change rate of inputs received (e.g., 50% throttle/second) by the input device. Additional information regarding determining when a user input corresponds to a hole shot or hole shot is provided in U.S. Pat. No. 10,018,136, which is incorporated by reference herein in its entirety.

If the demand does not exceed the demand threshold, step 306 is not performed (e.g., the second one or more marine drives is not yet operated) and the method continues to step 308. Step 308 then proceeds in a same or similar manner as steps 206 and 208 described above. In other words, if the demand from the input device does not correspond to a hole shot, the method 300 controls the second marine drive (and potentially other marine drives) in the same manner as the method 200. However, if the input demand corresponds to a hole shot, step 306 is performed instead of step 308, meaning that the second one or more marine drives is operated in a conventional manner corresponding to the input device demand rather than being postponed to reduce shift clunk. Additional information regarding this logic is provided below.

It should be recognized that other methods may also be used with those presently disclosed while controlling the propulsion system. For example, for a marine vessel having three or more marine drives (or in other words, two or more additional marine drives in which operation will be delayed according to the present disclosure to avoid shift clunk), these two or more additional marine drives may be synchronized according to the teachings of U.S. Pat. No. 11,358,698, which is incorporated by reference herein in its entirety. The different drives may also or alternatively be controlled according to the methods disclosed in U.S. Patent Application Publication No. US2022/0252153, which is also incorporated by reference herein in its entirety including the first marine drive and/or the second and beyond additional marine drives. These additional control factors may provide for improved performance, experience, and/or the like above and beyond the reduction in shift clunk of the present disclosure.

Figure 6:
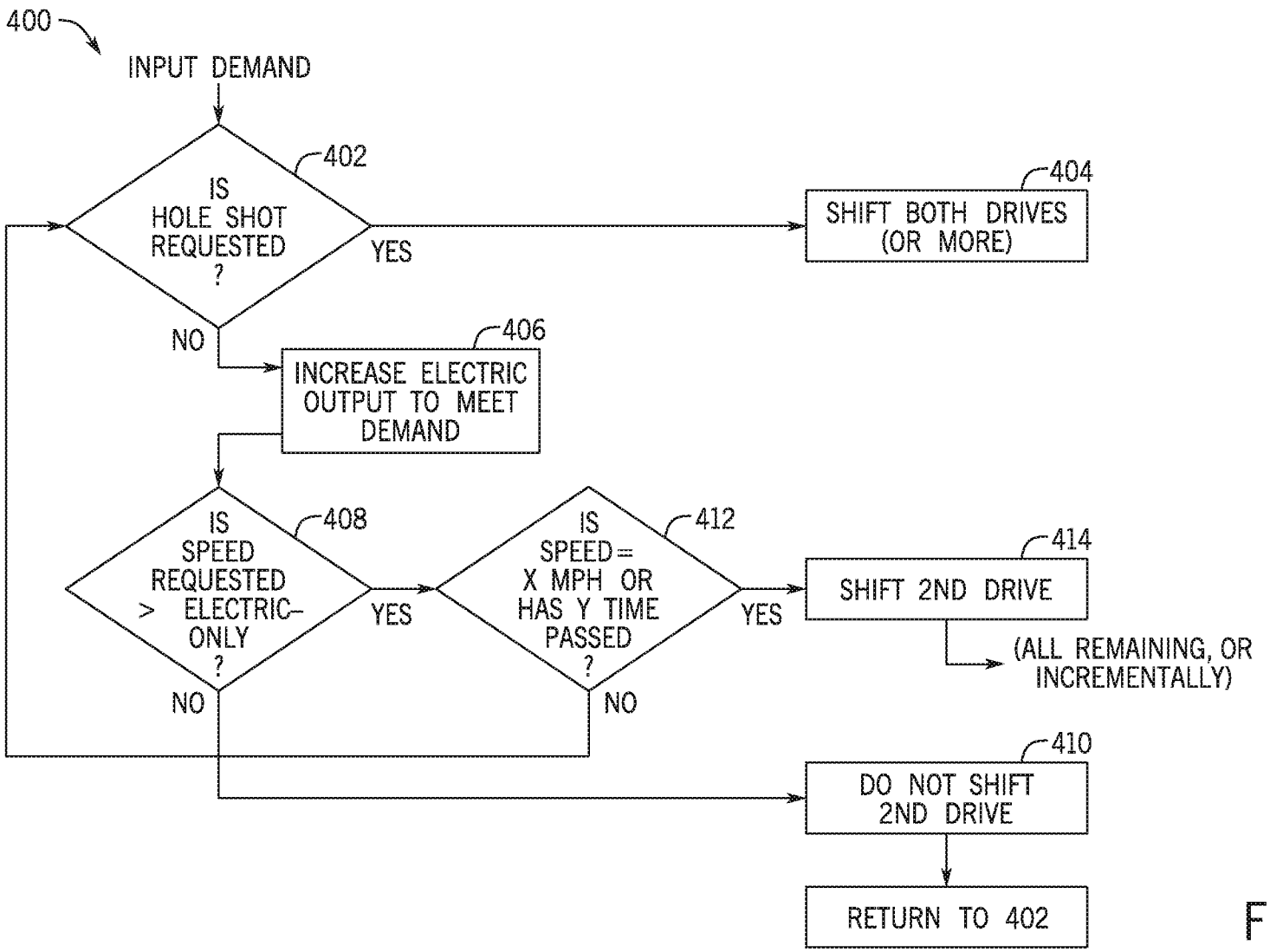
FIG. 6 is a flow chart showing another method for controlling a marine vessel to reduce shift clunk according to the present disclosure.

FIG. 6 depicts another method 400 for controlling a marine vessel to reduce shift clunk, in this example for a propulsion system having at least one electric marine drive and at least one ICE marine drive, which will be referred to in this example as the first one or more and second one or more marine drives. After an input demand is received (e.g., similar to the steps 202 or 302 discussed above), the method 400 provides for determining in step 402 whether the demand corresponds to a hole shot being requested. As stated above, this may be determined as the input demand exceeding a certain demand threshold (e.g., 90% powerhead output or others), moving from neutral to a certain threshold or from neutral to a certain threshold within a threshold time period (e.g., less than 1 second), the input demand changing faster than a threshold rate (e.g., 50% powerhead output/second), or others. In other words, step 402 determines whether the demand exceeds some demand threshold that corresponds to requesting fast acceleration or high performance for the marine vessel, whereby a reduction in shift clunk is outweighed by this demand for high output. If it is determined in step 402 that a hole shot has been requested (e.g., the user moving a throttle lever to 100%, wide open throttle), step 404 provides for shifting both (or all) the electric and the ICE marine drives right away to provide this high output without delay.

If instead step 402 determines that a hole shot has not been requested, step 406 provides for operating the first one or more marine drives to provide propulsion based on the demand. Step 408 further determines whether the demand provided from the input device exceeds the capability of the electric marine drive or drives alone (a non-shift threshold).

This capability may be stored as a demand threshold within the memory system, for example 10 mph, 8 mph, 5 mph, 4 mph, or other speeds based on the marine drive and the marine vessel. In certain embodiments, this value may be updated periodically by the control system based on actual performance, which accommodates for variables such as marine vessel loading, currents in the water, etc., which have an impact on the speed that the marine drive is capable of propelling the marine vessel. If the speed being requested does not exceed the capability or non-shift threshold of the electric marine drive in step 408, the process continues to step 410 in which the second one or more marine drives (and others, if present) are not shifting since they are not needed. The process then returns to step 402 to be repeated.

If instead in step 408 it is determined that the speed being requested does exceed that which the electric marine drive can provide itself, the non-shift threshold, the process continues to step 412. Step 412 then determines when to operate the second one or more marine drives so as to meet the demand of the user, but with the reduced shift clunk according to the present disclosure. In the example of FIG. 6, a preset criteria must be satisfied before the second one or more marine drives is operated, which may be satisfied by either of two separate mechanisms. A first of the mechanisms relates to the speed of the marine vessel (shown as variable X), and a second mechanism relates to an elapsed time since the first one or more marine drives started to provide propulsion for the marine vessel (shown as variable Y), each of which are compared in step 412. By way of example, a speed threshold for comparing to the speed may be 2 mph, 4 mph, 6 mph, 10 mph, or others corresponding to the point at which the second one or more marine drives is expected to be free wheeling enough to reduce or eliminate shift clunk when subsequently engaged, as discussed above. Likewise, an example of a time threshold for comparing to the elapsed time may be 0.5, 1, 5, 10, 15 second, or other times. The time threshold may be considered a "bailout" time at which point if the speed of the marine vessel hasn't reached the speed threshold for operating the second one or more marine drives with reduced shift clunk, the second one or more marine drives will shift anyway. The present inventors have identified that this feature is desirable in certain configurations to account for conditions in which the marine vessel may never reach the desired speed (e.g., an undersized electric marine drive, heavier marine vessel, and/or other factors). Similarly, the operator may be dissatisfied with reduced performance for too long of a duration, and would rather receive the feedback that the input device demands are being met.

As long as the speed of the marine vessel does not exceed the speed threshold (as measured in a manner described above), and the elapsed time since the first one or more marine drives began providing propulsion does not exceed the time threshold, the method provides for operating the first one or more marine drives alone (e.g., not yet operating the second marine drive). In this manner, the process provides that when the inquiry of step 412 results in a "no" condition, the process returns to step 402 to be repeated. However, once either the speed of the marine vessel exceeds the speed threshold, or the elapsed time since the first one or more marine drives started providing propulsion exceeds the time threshold, the second one or more marine drives is operated in step 414 according to the demand received from the input device.

If the speed of the marine vessel exceeds the speed threshold, operating the second marine drive will cause little to no shift clunk for the reasons provided above. However, even if the second one or more marine drives is operated due to the elapsed time exceeding the time threshold, the inventors have identified that the method advantageously provides that the shift clunk may still be significantly reduced by the second one or more marine drives free wheeling to some extent ahead of its engagement.

Figure 7:
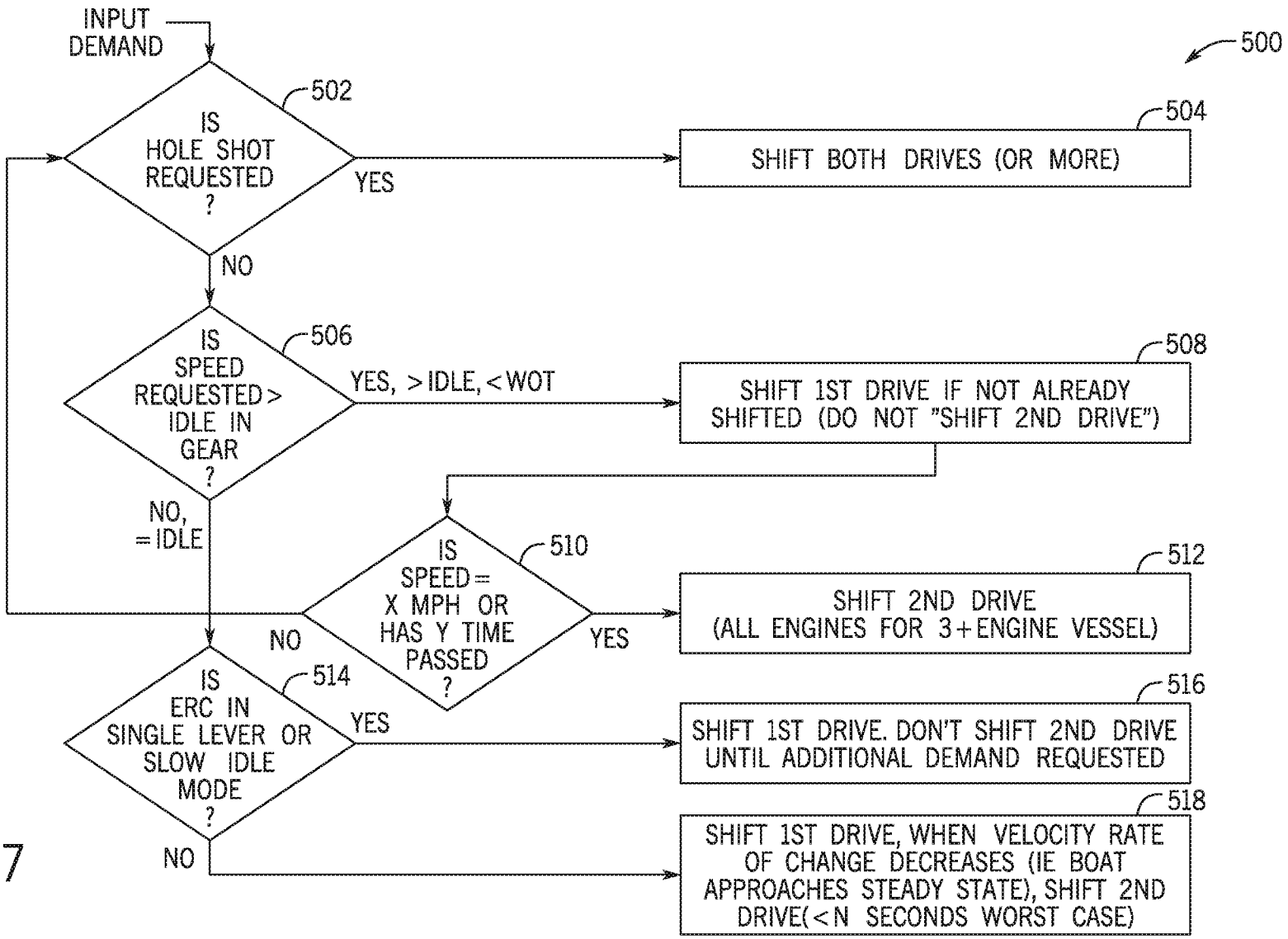
FIG. 7 is a flow chart showing another method for controlling a marine vessel to reduce shift clunk according to the present disclosure.

FIG. 7 shows another example method according to the present disclosure, in this case for a marine vessel having an input device controllable such that a single input can selectively control operation of two or more marine drives. By way of example, this input device may be a Next Gen DTS (Digital Throttle and Shift) Multi-Engine Electronic Remove Control (ERC) input device for controlling two to six marine drives, which is produced by Mercury Marine™ of Fond du Lac, WI. This input device comprises two separate throttle levers that, for example, in certain operating modes may be moveable to independently control the throttle and shifting of two or more (or all) separate marine drives. In other operating mode, the same input device may be useable such that a single lever of the two levers can effectuate control of the throttle and shifting for the two or more separate marine drives. In other words, the second lever is not required for controlling the second marine drive. Since these DTS devices are commercially available, additional details are not provided herein.

The method 500 of FIG. 7 is also provided for an example in which the propulsion system includes two or more ICE marine drives. Steps 502 and 504 may proceed in the same or a similar manner as steps 402 and 404 and are not repeated for brevity. Step 506 may proceed in a similar manner as step 408, but rather than comparing the requested speed to a non-shift threshold that corresponds to a capability of the first one or more marine drives, the non-shift threshold is set to correspond to a speed of the marine vessel when the first one or more marine drives is operated at idle speed (e.g., 3 mph, 5 mph, or others depending on the marine drive, the marine vessel, and/or other factors). The present inventors have recognized that it is advantageous to delay shifting multiple marine drives into gear where doing so would cause the marine vessel to travel faster than desired, or in other words, faster than the corresponding demand from the input device. Thus, step 506 ensures that when the slowest speeds are requested, the propulsion system is operated in a manner best suited to accurately provide these slower speed requests.

If the speed is determined in step 506 to exceed the non-shift threshold corresponding to idle speed, the method proceeds to step 508, whereby the first one or more marine drives is shifted into operation, but without immediately shifting the second one or more marine drives and any others (similar to step 414). The method then proceeds to step 510, which may be performed in the same or a similar manner as step 412. As long as the speed of the marine vessel does not exceed the speed threshold (variable X, as described above with respect to step 412), and the elapsed time since the first one or more marine drives began providing propulsion does not exceed the time threshold (variable Y, as discussed above), the method provides for operating the first one or more marine drives alone until the other marine drives are free wheeling fast enough to avoid shift clunk when subsequently operated. In this manner, the process provides that when the inquiry of step 510 results in a "no" condition, the process returns to step 502 to be repeated. However, once either the speed of the marine vessel exceeds the speed threshold, or the elapsed time since the first marine drive started providing propulsion exceeds the time threshold, the second one or more marine drives is operated in step 512 according to the demand received from the input device. As stated above, even if the second marine drive is operated before the speed threshold is reached, any shift clunk from operating the second one or more marine drives may still be significantly reduced by the second marine drive free wheeling to some extent ahead of its engagement.

With continued reference to FIG. 7, additional discussion is now provided for the condition in which the inquiry of step 506 is returned "no", meaning that the demand requested from the input device does not exceed the non-shift threshold associated with idling. In other words, the demanded speed is equal to the speed provided by operating the first one or more marine drives in idle (stored in memory and in certain examples, updated based on real measured conditions). In this case, the process continues with step 514, which determines whether the input device is configured to control multiple marine drives with a single input (e.g., via a single lever for a Mercury Marine™ ERC dual throttle handle device as the input device, as discussed above), or whether a slow idle mode has been activated. The slow idle mode corresponds to a request to allow the marine vessel to operate at lower speeds by not operating more marine drives than needed. It should be recognized that this slow idle mode functionality is independent of reducing shift clunk. Either or both functions can be provided by a given system as disclosed herein.

If the input device is operating such that a single input controls multiple marine drives, or the slow idle mode is engaged, the method proceeds to step 516, shifting the first one or more marine drives without shifting the second one or more marine drives until additional demand is requested. By way of example, the demand may be compared to a demand threshold associated with idling speed, such as the throttle lever being positioned at 5% throttle, another position corresponding to a forward idle detent, just past the forward idle detent, a position high enough above a nominal idle position so as to indicate an intended desire to no longer idle (e.g., 15%, 10%, or 8% throttle), or other values. In this case, the present inventors have recognized that it is helpful to not operate the second one or more marine drives (and potentially more) since the additional output is either not needed or not desired (i.e., slow idle mode). Furthermore, because the single input is intended to control both the first one or more and second one or more marine drives, or in other words the operator did not provide express input for the second one or more marine drives on its own, controlling the propulsion system to not operate the second one or more marine drives is not in conflict with the operator's request.

In contrast, if either condition of step 514 is not met (i.e., a determination of "no"), the method proceeds to step 518, which provides that the second one or more marine drives will eventually shift. For the method shown, step 518 provides for immediately shifting the first one or more marine drives and delaying operation of the second one or more marine drives until after a velocity of the marine vessel changing due to operation of the first one or more marine drives falls below a change rate threshold. In other words, the first one or more marine drives continues to propel the marine vessel alone until the increase in speed tapers off to below a change rate threshold (e.g., 1 mph/second, 0.5 mph/second) indicating that little additional progress for the marine vessel speed will be made or made in a timely manner. At that time, or if a second bailout time since the first one or more marine drives started operating is exceeded (shown as variable N, e.g., 10 seconds, 20 seconds, 30 seconds), the second marine drive is also engaged for operation. In this manner, step 518 provides that the marine vessel may try to avoid shift clunk at low speeds unless the demanded speed is still not being achieved within a certain amount of time, at which point additional marine drives will be operated despite the potential for shift clunk. However, the method 500 provides that the second one or more marine drives will eventually be operated since its operation is being requested. In particular, the fact that the ERC is not in a single lever mode means that the input device must be receiving a second input for controlling the second one or more marine drives (e.g., via a second throttle lever), and as such the second one or more marine drives should eventually be operated even if shift clunk would occur.

Figure 8:
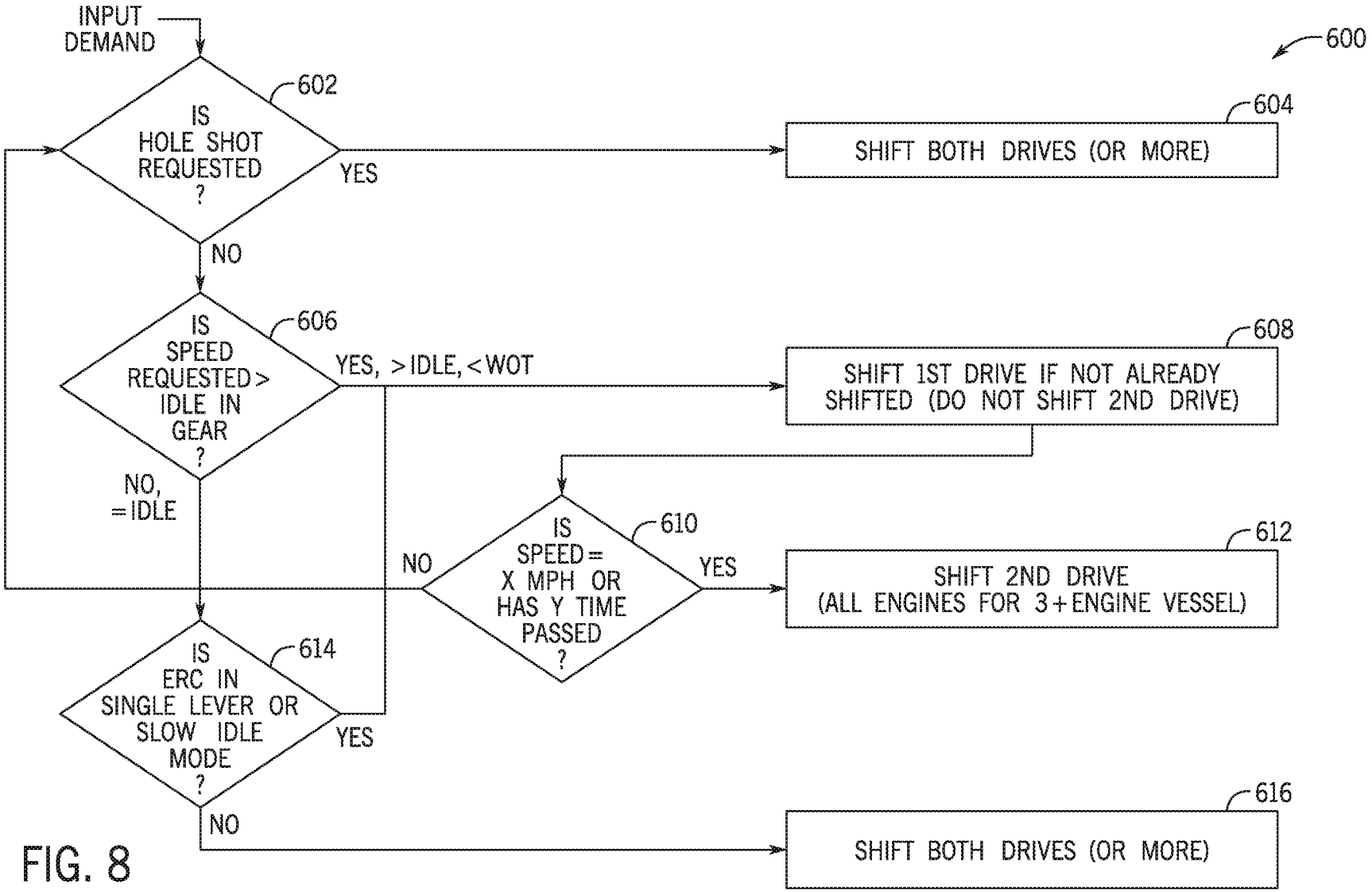
FIG. 8 is a flow chart showing another method for controlling a marine vessel to reduce shift clunk according to the present disclosure

FIG. 8 shows a further method 600 according to the present disclosure, which is also shown for a marine vessel having two or more ICE marine drives. For brevity, steps 602 through 614 may proceed in a same or similar manner as 502 through 514 and are thus not repeated here. However, if the determination of step 614 results in a "yes", the method 600 proceeds to step 608, whereby the first one or more marine drives is shifted. Method 600 then proceeds to step 610, which may proceed similarly to step 510 or step 412 discussed above. The method continues to step 612 based on whether the preset criteria of step 610 are satisfied. In this manner, the second one or more marine drives will shift at the latest after the time threshold (variable Y) has elapsed, rather than waiting for additional demand being requested as in step 516 of the method 500.

Also in contrast to the method 500 of FIG. 7, the method 600 of FIG. 8 provides that is the determination of step 614 is determined in the negative, both the first one or more and second one or more marine drives are immediately shifted in step 616, rather than waiting for the marine vessel's speed to first level out from operating the first one or more marine drives alone. In this case, if the ERC is not in a single lever mode, the input device must be receiving a second input for controlling the second one or more marine drives (e.g., via a second throttle lever), and the method 600 provides for instantly following this request rather than delaying for avoiding shift clunk.

The present disclosure contemplates systems and methods in which the various thresholds described above may be selected or changed based on the particular marine drives, marine vessel, user preferences, and/or the like. Additionally, a given propulsion system may have selectable settings that allow the operator to choose between methods of FIGS. 6-8 for controlling the two or more marine drives.

In addition, whereas the previous examples largely focused on shifting in two steps, a first one or more marine drives and, after a delay, a second one or more marine drives, this may be further divided such that third marine drives and so on are also not operated until after similar delays as those discussed above. However, the present inventors have identified that in many configurations, once the speed threshold is met such that the second one or more marine drives is sufficiently free wheeling to avoid shift clunk, any additional marine drives are typically also benefitting from the same freewheeling and thus can also be shifted into operation at the same time as the second one or more marine drives.

In this manner, the present systems and methods provide for reduced or eliminated shift clunk for operating two or more marine drives. It should be recognized that the systems and methods described herein advantageously allow existing designs of marine drives to be used by changing the control thereof according to the present disclosure. This simplifies the process in manufacturers implementing the improvements described herein, and also permits upgrading existing marine vessels.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A method for controlling a marine vessel, the method comprising:

receiving from an input device a demand for propelling the marine vessel in water;

operating a first marine drive to provide propulsion based on the demand from the input device;

determining whether a preset criteria has been satisfied, the preset criteria being satisfied based on a speed of the marine vessel and/or an elapsed time since the first marine drive started providing propulsion; and delaying operation of a second marine drive to provide propulsion based on the demand from the input device until the preset criteria has been satisfied.

2. The method according to claim 1, wherein operating the first marine drive comprises operating an electric motor thereof to provide the propulsion.

3. A method for controlling a marine vessel, the method comprising:

receiving from an input device a demand for propelling the marine vessel in water;

operating a first marine drive to provide propulsion based on the demand;

determining whether the demand exceeds a demand threshold;

operating a second marine drive to provide propulsion based on the demand when the demand exceeds the demand threshold; and determining, when the demand does not exceed the demand threshold, whether a preset criteria has been satisfied, the preset criteria being satisfied based on a speed of the marine vessel and/or an elapsed time since the first marine drive started providing propulsion, and delaying operation of a second marine drive to provide propulsion based on the demand until the preset criteria has been satisfied.

4. The method according to claim 3, wherein operating the first marine drive comprises operating an electric motor thereof to provide the propulsion.

5. The method according to claim 4, wherein operating the second marine drive comprises operating an engine thereof to provide the propulsion.

6. The method according to claim 3, wherein the demand threshold is at least 80% of wide open throttle.

7. The method according to claim 3, wherein determining whether the preset criteria is satisfied comprises measuring the speed of the marine vessel via a speed sensor and comparing the speed to a speed threshold.

8. The method according to claim 7, wherein the speed threshold is between 2 and 10 mph.

9. The method according to claim 3, wherein determining whether the preset criteria is satisfied comprises inferring the speed of the marine vessel via a sensor associated with the first marine drive.

10. The method according to claim 9, wherein the sensor of the first marine drive measures a rotational speed corresponding to the first marine drive.

11. The method according to claim 3, wherein determining whether the preset criteria is satisfied comprises counting the elapsed time since the first marine drive started to provide the propulsion and the preset criteria is satisfied when the elapsed time exceeds a time threshold.

12. The method according to claim 11, wherein the time threshold is between 0.5 and 5 seconds.

13. The method according to claim 3, wherein the preset criteria can be satisfied by either the speed of the marine vessel exceeding a speed threshold or the elapsed time since the first marine drive started providing propulsion exceeding a time threshold after which the second marine drive is operated regardless of the speed of the marine vessel.

14. The method according to claim 13, wherein the time threshold is between 2 and 15 seconds.

15. The method according to claim 3, wherein determining whether the preset criteria has been satisfied comprises determining a rate of change of the speed of the marine vessel while the first marine drive is operating and comparing the rate of change to a change rate threshold such that the preset criteria is satisfied when the rate of change is below the change rate threshold.

16. A propulsion system for a marine vessel, the propulsion system comprising:

a first marine drive and a second marine drive each configured to provide propulsion for the marine vessel in water;

an input device configured to provide a demand for propelling the marine vessel; and a controller operatively coupled to the first marine drive, the second marine drive, and the input device, the controller being configured to control the first marine drive to provide the propulsion based on the demand received from the input device, to determine whether a preset criteria has been satisfied, the preset criteria being satisfied based on a speed of the marine vessel and/or an elapsed time since the first marine drive started providing propulsion, and to delay the second marine drive providing the propulsion based on the demand received from the input device until the preset criteria has been satisfied.

17. The propulsion system according to claim 16, wherein the preset criteria can be satisfied by either the speed of the marine vessel exceeding a speed threshold or the elapsed time since the first marine drive started providing propulsion exceeding a time threshold after which the second marine drive is operated regardless of the speed of the marine vessel.

18. The propulsion system according to claim 17, wherein the time threshold is between 2 and 15 seconds.

19. The propulsion system according to claim 16, wherein the first marine drive comprises an electric motor for providing the propulsion.

20. The propulsion system according to claim 16, wherein the second marine drive is at least two second marine drives, and wherein after the preset criteria is satisfied the at least two second marine drives are controlled to provide the propulsion corresponding thereto together.

21. A method for controlling a marine vessel, the method comprising:

receiving from an input device a demand for propelling the marine vessel in water;

determining whether a slow idle mode has been selected for propelling the marine vessel;

operating a first marine drive to provide propulsion based on the demand from the input device;

operating a second marine drive to provide propulsion based on the demand from the input device when the slow idle mode is determined to be unselected; and determining, when the slow idle mode is determined to be selected, whether the demand exceeds a demand threshold, and delaying operation of the second marine drive to provide propulsion based on the demand from the input device until the demand exceeds the demand threshold.

* * * * *